United States Patent [19]

Araoka

[11] 3,945,761

[45] Mar. 23, 1976

[54] FAN DISTURBING SAND AT THE BOTTOM OF A BODY OF WATER SO THAT IT MAY BE PUMPED UP EFFICIENTLY

[76] Inventor: Toshinobu Araoka, 1308 Orio, Yahata, Kitaky ushu, Fukuoka, Japan

[22] Filed: Sept. 2, 1971

[21] Appl. No.: 177,893

[52] U.S. Cl. ..... 416/188; 416/243; 37/67; 37/77

[51] Int. Cl.[2] ..... E02F 3/00

[58] Field of Search ..... 37/67, 64, 65, 77; 416/242, 188

[56] References Cited

UNITED STATES PATENTS

| | | | |
|---|---|---|---|
| 725,818 | 4/1903 | Bates | 37/67 X |
| 1,316,349 | 9/1919 | Calder | 37/67 |
| 1,759,490 | 5/1930 | Neveling | 37/67 |
| 1,842,537 | 1/1932 | Brunner | 37/67 |
| 2,352,394 | 6/1944 | Little | 37/67 |
| 2,461,311 | 2/1949 | Cushing et al. | 37/67 X |
| 3,148,464 | 9/1964 | Jones | 37/67 |

*Primary Examiner*—Clifford D. Crowder
*Attorney, Agent, or Firm*—Brisebois & Kruger

[57] ABSTRACT

A fan for use with pumps for pumping up sand from the bottom of a body of water having certain uniquely shaped vanes around the circumference of a truncated cone.

1 Claim, 12 Drawing Figures

FAN DISTURBING SAND AT THE BOTTOM OF A BODY OF WATER SO THAT IT MAY BE PUMPED UP EFFICIENTLY

SUMMARY OF THE INVENTION

This invention relates to a fan for disturbing sand which is to be pumped up by sand pumps from the bottom of a body of water.

The object of this invention is to provide a fan which disturbs the sand at the bottom of the water over a wide area, and at the same time causes it to rise in a dispersed condition and be drawn up by the pump smoothly, with high efficiency.

Conventional fans for use with pumps for dredging up sand from the bottom of the water, have had vanes around the circumference of a cylinder, the object of which was to stir up the sand, but have had a low efficiency in sucking up the sand. When the fan was rotated at high speed so as to suck the sand in a short time before it settled, it promptly fell back in place. My new fan disturbs the sand sufficiently, sucks it up effectively, wears well, and excavates widely and efficiently.

These and other advantages of this invention will be better understood upon consideration of the following detailed description of several embodiments of the invention with reference to the accompanying drawings, in which.

Referring now to FIGS. 1–12, the illustrated embodiments of the cutter according to this invention will now be described.

Figure 3:
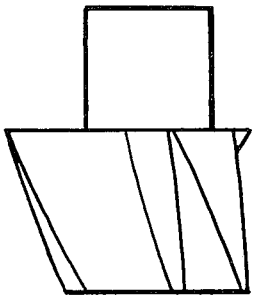
FIG. 3 is a front view of a second embodiment of a fan for disturbing sand at the bottom of the water according to this invention.
Figure 1:
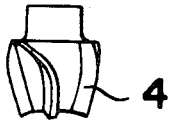
FIG. 1 is a front view of a first embodiment of a fan for disturbing sand at the bottom of the water so that it may be pumped up efficiently.
Figure 4:
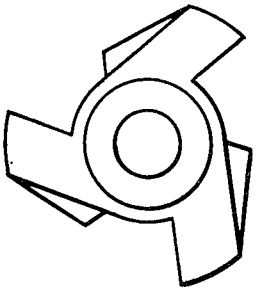
FIG. 4 is a top plan view of the fan of FIG. 3.
Figure 2:
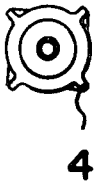
FIG. 2 is a top plan view of the same fan.
Figure 5:
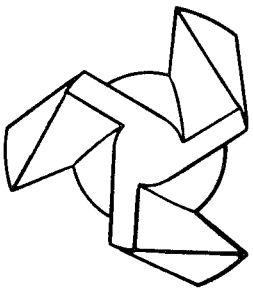
FIG. 5 is a bottom view of the same fan.
Figure 12:
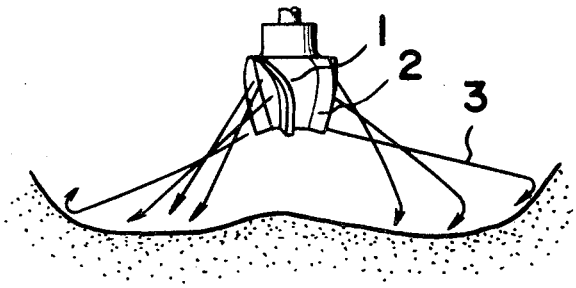
FIG. 12 is an illustration of the operation of a fan according to this invention.
Figure 6:
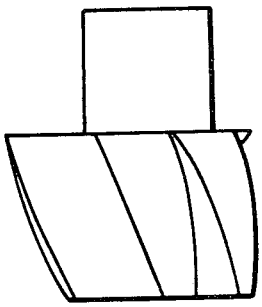
FIG. 6 is a front view of the third embodiment of a fan for disturbing sand at the bottom of the water according to this invention.
Figure 9:
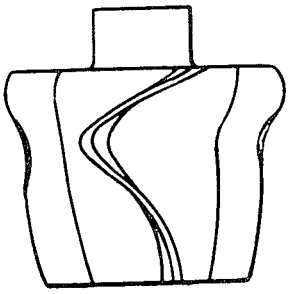
FIG. 9 is a front view of the fourth embodiment of a fan for disturbing sand at the bottom of the water according to this invention.
Figure 7:
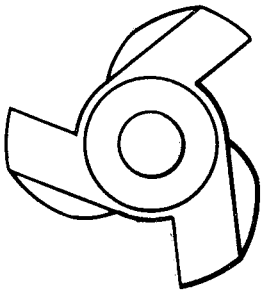
FIG. 7 is a top plan view of the fan of FIG. 6.
Figure 10:
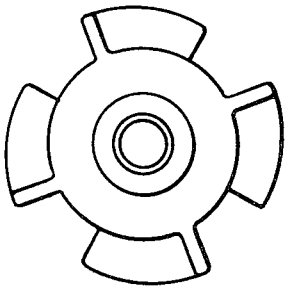
FIG. 10 is a top plan view of the fan of FIG. 9.
Figure 8:
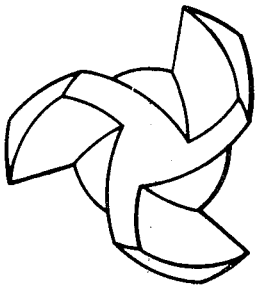
FIG. 8 is a bottom view of the same fan.
Figure 11:
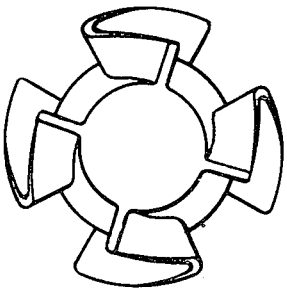
FIG. 11 is a bottom view of the same fan.

As shown in FIG. 12, the fans 2 produce a downward whirlpool current 3 around the circumference of a truncated cone 1. In one type of fan (4), illustrated in FIGS. 1 and 2, the lower parts of the vanes are straight and the upper parts curve toward the direction of rotation of the truncated cone. In FIGS. 3–5, the blades of the fan lie at an angle to the axis of the fan. In FIGS. 6–8, the blades curve gently with respect to the axis of the fan. And in FIGS. 9–11, the upper parts of the blades curve first in one direction and then in the other.

In operation, a truncated cone having vanes of the first, second, third or fourth type around its circumference, is mounted at the bottom of any suitable pump, and upon rotation thereof a wide area is excavated, thoroughly disturbing the sand at the bottom of the water, so that the pumping up which is the fundamental purpose of any sand pump is done efficiently.

What is claimed is:

1. A fan for hydraulically disturbing sand at the bottom of a body of water, said fan comprising a central supporting member having a frusto-conical outer surface which is larger at its upper than its lower end and a plurality of vanes attached along their inner edges to said surface, said vanes being circumferentially distributed about said supporting member and extending for a substantially uniform distance from said frustoconical surface throughout their lengths, the lower part of each vane being substantially straight while its upper part is curved toward the direction of rotation of the fan.

* * * * *